US008425024B2

(12) United States Patent
Kurobe

(10) Patent No.: US 8,425,024 B2
(45) Date of Patent: Apr. 23, 2013

(54) LIQUID EJECTION APPARATUS AND PRINTING APPARATUS

(75) Inventor: Ryoichiro Kurobe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 13/218,719

(22) Filed: Aug. 26, 2011

(65) Prior Publication Data

US 2012/0050429 A1 Mar. 1, 2012

(30) Foreign Application Priority Data

Aug. 30, 2010 (JP) ..... 2010-192352

(51) Int. Cl.
*B41J 2/175* (2006.01)

(52) U.S. Cl.
USPC ..... 347/93

(58) Field of Classification Search ..... 347/84, 347/85, 86, 87, 92, 93
See application file for complete search history.

(56) References Cited

U.S. PATENT DOCUMENTS

| | | | | |
|---|---|---|---|---|
| 6,120,140 | A * | 9/2000 | Hirosawa et al. | 347/93 |
| 6,158,855 | A * | 12/2000 | Saikawa | 347/93 |
| 6,217,164 | B1 * | 4/2001 | Hino | 347/85 |
| 7,063,414 | B2 * | 6/2006 | Harakawa | 347/93 |
| 2007/0115333 | A1 | 5/2007 | Aruga et al. | |

FOREIGN PATENT DOCUMENTS

JP 3606282 B2 1/2005

* cited by examiner

*Primary Examiner* — Anh T. N. Vo
(74) *Attorney, Agent, or Firm* — Fitzpatrick, Cella, Harper & Scinto

(57) ABSTRACT

The present invention is, in a liquid ejection apparatus provided with: a movable ejecting portion for ejecting liquid; and an intermediate supply path that is provided so as to supply the liquid contained in a liquid containing body arranged separately from the ejecting portion to the ejecting portion, provided with: a filter chamber that is movable together with the ejecting portion; and a valve unit that is positioned on a downstream side of the filter chamber. The filter chamber is provided with: a filter member arranged in a position distant, by a predetermined distance vertically downward, from the supply port communicatively connected with a downstream end of the intermediate supply path, and a plurality of liquid paths that extend so as to guide the liquid introduced from the supply port toward the filter member.

6 Claims, 7 Drawing Sheets

LIQUID EJECTION APPARATUS AND PRINTING APPARATUS

BACKGROUND OF THE INVENTION

1. Field of the Invention

The present invention relates to a liquid ejection apparatus for ejecting liquid such as ink, and a printing apparatus provided with the liquid ejection apparatus.

2. Description of the Related Art

As a liquid ejection apparatus that jets liquid onto a target, an ink ejection apparatus applied to an inkjet printing apparatus is known. The ink ejection apparatus of the inkjet printing apparatus is typically provided with an ink cartridge, and a printing head that is supplied with ink in the ink cartridge. The printing head has an ejection port (nozzle) for ejecting (jetting) the ink; is mounted on a carriage that moves with respect to a printing material; and is moved with respect to the printing material. The ink ejection apparatus can eject the ink from the ejection port at a desired position and desired timing with respect to the printing material so as to form an image including pictures, lines, characters, and the like on the printing material.

For the ink cartridge, a configuration in which the ink cartridge can be detachably attached onto the carriage mounted with the printing head may be employed. On the other hand, a configuration in which the ink cartridge is arranged with being separated from the carriage (referred to as an off carriage type) is also known. Such an off carriage type ink cartridge is configured to supply ink to a printing head mounted on the carriage through a flexible tube. An inkjet printing apparatus provided with such an off carriage type ink cartridge can mount a large volume ink cartridge thereon, and therefore has an advantage that even in the case of large volume printing, a replacement frequency of the ink cartridge is low.

In the case of the inkjet printing apparatus provided with such an off carriage type ink cartridge, when a large-sized printing material is handled, a length for routing the tube for ink supply is increased. This may result in an increase in dynamic pressure (pressure loss) of the ink from the ink cartridge to the carriage, and the occurrence of a pressure variation in the ink due to acceleration/deceleration of the carriage. Accordingly, in such a case, it is difficult for such an inkjet printing apparatus to stably eject the ink from the printing head.

For this reason, the inkjet printing apparatus provided with such an off carriage type ink cartridge employs a configuration in which a sub-tank that can retain the ink is mounted on the carriage, and the ink inside the ink cartridge is transported under pressure to the sub-tank. Note that the ink supplied to the sub-tank is, after its pressure has been adjusted in the sub-tank, supplied to the printing head. An example of an inkjet printing apparatus having such a configuration is disclosed in Japanese Patent No. 3606282.

An ink supply apparatus of an inkjet printing apparatus in Japanese Patent No. 3606282 is, in a sub-tank, provided with a valve unit that has a self sealing function. The valve unit is provided with: an ink supply chamber that is connected to an ink cartridge through a tube; a valve that opens/closes a supply path; a biasing member that biases the valve so as to close the supply path; and a pressure chamber and a film member for opening the valve. Note that the pressure chamber is brought to negative pressure due to ink ejection from a printing head, and due to the negative pressure, the film member operates so as to open the valve. Also, such a sub-tank in Japanese Patent No. 3606282 is provided with a filter chamber on an ink cartridge side with respect to the valve, in the supply path. The filter chamber has a foreign matter removing function, and also has a function to prevent a bubble in ink from reaching the printing head. A bubble captured by a filter member of the filter chamber can accumulate in a vertically upper part within the filter chamber. Note that a volume of a space where such a bubble accumulates is finite, and therefore in the inkjet printing apparatus, such a bubble can be periodically discharged by discharge operation that applies negative pressure from an ejection port, but cannot be completely removed.

The above-described filter chamber plays a role of removing the bubble from the ink as described above; however, on the other hand, in order to prevent the ink from ending, it is required to ensure that the ink passes through the filter member. However, in the filter chamber of the sub-tank in Japanese Patent No. 3606282, due to a flow path configuration of the supply path, a space region for bubble accumulation may be expanded to a periphery of an ink supply port to the filter chamber. For this reason, when the ink is supplied, a bubble in the filter chamber may be pressed by ink flow; brought into contact with the filter member; and cover part or all of a surface of the filter member. This causes an effective area of the filter member to be reduced, which may affect ink supply.

In order to prevent a bubble from being brought into contact with the filter member in the filter chamber having a finite volume, for example, it is necessary to frequently perform the above-described bubble discharge operation to keep a predetermined amount of ink or more between the bubble accumulating in the filter chamber and the filter member. However, such a countermeasure means an increase in the number of performances of the discharge operation, and therefore may result in an increase in amount of ink that is uselessly discharged with a bubble.

SUMMARY OF THE INVENTION

The present invention is made in consideration of such a point, and an object thereof is, in a liquid ejection apparatus such as an ink ejection apparatus, without increasing an amount of wasted liquid such as ink, to achieve both trapping of a bubble, and stable supply of the liquid.

One aspect of the present invention provides a liquid ejection apparatus provided with: a movable ejecting portion for ejecting liquid; and an intermediate supply path that is provided so as to supply the liquid contained in a liquid containing body arranged separately from the ejecting portion to the ejecting portion, the liquid ejection apparatus comprising: a filter chamber provided movably together with the ejecting portion, the filter chamber being provided with a supply port communicatively connected with a downstream end of the intermediate supply path, a filter member arranged in a position distant from the supply port by a predetermined distance vertically downward, and a plurality of liquid paths that extend so as to guide the liquid introduced from the supply port toward the filter member; and a valve unit that is provided movably together with the ejecting portion between the filter chamber and the ejecting portion so as to adjust a supply of the liquid to the ejecting portion. Also, another aspect of the present invention provides a printing apparatus comprising such a liquid ejection apparatus.

The present invention is provided with the above configuration, and therefore enables the liquid to be more surely supplied to the filter member through the plurality of liquid paths. Accordingly, the present invention is not required to frequently perform the above-described bubble discharge operation, and without increasing an amount of wasted liquid, enables both trapping of a bubble, and stable supply of the liquid to be achieved.

Further features of the present invention will become apparent from the following description of exemplary embodiments (with reference to the attached drawings).

DESCRIPTION OF THE EMBODIMENTS

The present invention will hereinafter be described in detail on the basis of embodiments. Note that, in the following description, the present invention is described in terms of an ink ejection apparatus and an inkjet printing apparatus applied with the ink ejection apparatus. However, the present invention is not limited to the ink ejection apparatus that ejects (jets) ink, but can be applied to liquid ejection apparatuses having various configurations for ejecting various types of liquids (including printing liquid) other than the ink. Also, such a liquid ejection apparatus according to the present invention can be applied to, in addition to a general printing apparatus, apparatuses such as a copier, facsimile having a communication system, and word processor having a print part. Further, the liquid ejection apparatus according to the present invention can be applied to industrial and home-use printing apparatuses (image forming apparatuses) that are combined with various processors in a complex manner.

Figure 1:
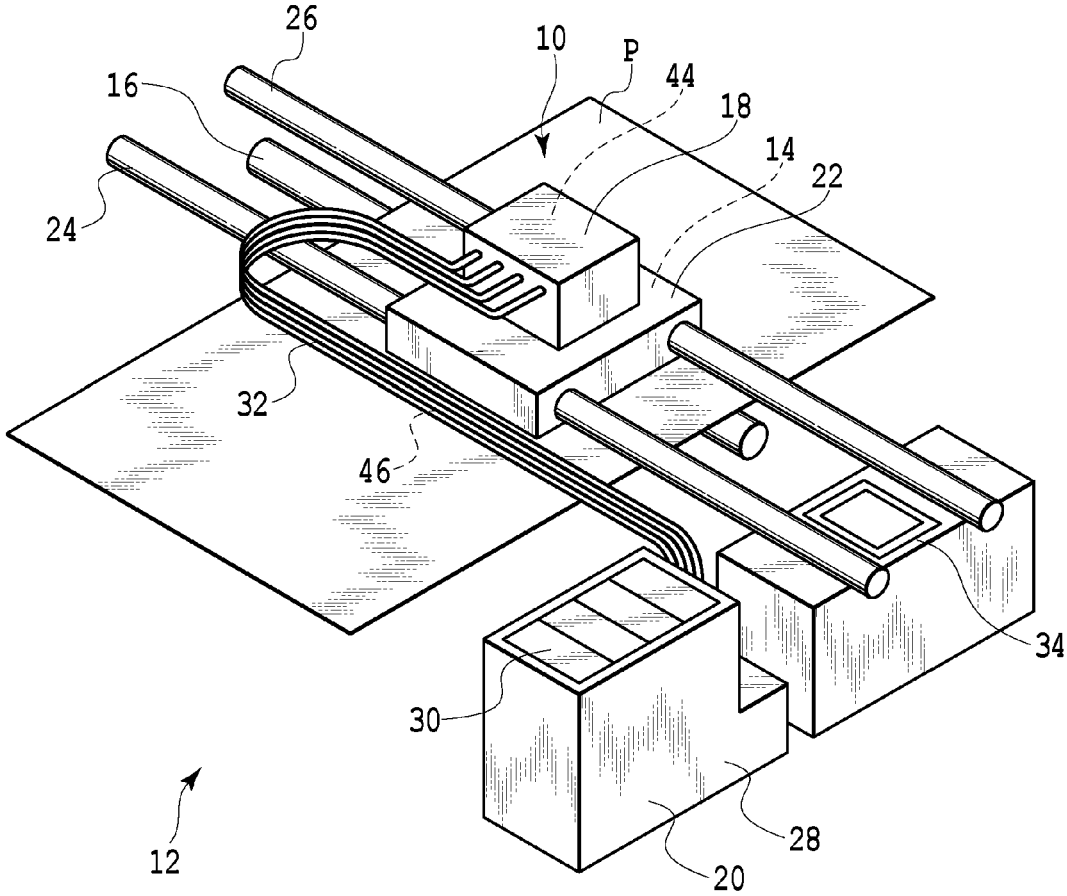
FIG. 1 is a schematic diagram illustrating a relationship between a liquid ejection apparatus in a printing apparatus according to a first embodiment of the present invention and its related apparatuses.

In the following, a first embodiment of the present invention is first described. First, a schematic configuration of an inkjet printing apparatus (hereinafter referred to as a printing apparatus) 12 applied with an ink ejection apparatus 10 that is a liquid ejection apparatus of the first embodiment of the present invention is described on the basis of FIG. 1.

The printing apparatus 12 is configured to include a feeding portion, a conveying portion, the ink ejection apparatus 10, and a discharging portion. A printing material P is placed on the feeding portion (not illustrated), and sent from the feeding portion to the conveying portion. On the printing material P that is conveyed by the conveying portion, ink is ejected from a printing head 14 of the ink ejection apparatus 10 to thereby form an image (including characters and lines). Subsequently, the printing material P formed with the image is discharged by the discharging portion (not illustrated). Such operation of the respective components is controlled by a control unit, i.e., a controller, on the basis of signals from various sensors and/or input apparatus, and the like. As described, the printing apparatus 12 can eject the ink onto the printing material P at desired timing to form a desired image. Note that, as the printing material P, various media can be used, and for example, paper, plastic material, and film can be used.

The feeding portion is configured so as to be able to feed printing materials P to the conveying portion with separating the printing materials P one-by-one. The conveying portion is provided with a motor-driven conveying roller 16 for conveying the printing materials P, and a pinch roller driven by the conveying roller 16. The pinch roller is biased by a spring to come into press contact with the conveying roller 16, and thereby conveying force for the printing material P is generated. The discharging portion is provided with a discharging roller.

The printing apparatus 12 is provided with the controller (not illustrated) as described above. A feeding apparatus is configured to include the feeding portion and a part of the controller for controlling the operation of the feeding portion. Similarly, a conveying apparatus is configured to include the conveying portion and a part of the controller for controlling the operation of the conveying portion. Similarly, a discharging apparatus is configured to include the discharging portion and a part of the controller for controlling the operation of the discharging portion. Also, the ink ejection apparatus 10 is configured to include a part of the controller.

The ink ejection apparatus 10 is provided with the printing head 14 serving as an ejecting portion, sub-tank 18, and liquid containing portion 20 that is arranged separately from the printing head 14.

The printing head 14 is provided with a plurality of ejection ports, i.e., nozzles, for ejecting ink, and mounted on a movable carriage 22. That is, the printing head 14 is provided movably together with the carriage. The carriage 22 is supported by guide members 24 and 26 so as to be able to reciprocate in a direction orthogonal to a conveying direction of the printing material P. On such a carriage 22, the sub-tank 18 is also mounted. Accordingly, the sub-tank 18 is provided movably together with the carriage. The sub-tank 18 is, as will be described later in detail, provided with a filter chamber and a valve unit, and configured to supply the ink to the printing head 14. Note that in this embodiment, an ink ejection configuration of the printing head 14 is made as follows; however, it can be changed to another configuration. In this embodiment, the ink ejection configuration is made such that, according to a printing signal from the controller, an electrothermal transducing body is energized, and on the basis of growth and shrinkage of a bubble generated in the ink with use of film boiling generated in the ink by corresponding thermal energy, the ink is ejected from the ejection ports to perform printing.

The liquid containing portion 20 is arranged separately from the carriage 22, and provided with a holding member 28 that is fixed to a chassis or the like of the printing apparatus 12.

The holding member 28 is detachably attached with an ink cartridge 30 serving as a liquid containing body. In this embodiment, four ink cartridges 30 can be attached to the holding member 28 such that the printing apparatus 12 can eject four color inks. Corresponding to this, the above-described printing head 14 is provided with the ejection ports for the respective color inks.

The holding member 28 of the liquid containing portion 20 and the sub-tank 18 are connected to each other through flexible tubes 32. In this embodiment, the number of the tubes 32 is four. Through each of the tubes 32, corresponding one of the inks contained in the respective ink cartridges is supplied to the sub-tank 18. The liquid containing portion 20 is provided with an unillustrated pump that operates on the basis of an output signal from the controller, and by operation of the pump, the inks containing in the ink bags (liquid containing bodies) of the ink cartridges 30 are transported under pressure and supplied to the sub-tank 18. Note that the liquid containing portion is not necessarily provided with the pump, and in this case, the liquid containing portion can be configured to supply the inks in the ink cartridges on the basis of a water head difference. Specifically, in this case, in order to generate the water head difference, the holding member may be positioned vertically above the sub-tank.

As described, the inks are transported under pressure from the fixed ink cartridges 30 to the sub-tank 18, and once accumulated in the sub-tank 18. Then, pressures applied on the inks are adjusted in the sub-tank 18, and the inks are appropriately supplied to the printing head 14. At appropriate timing, from the ejection nozzles of the printing head 14, the inks are ejected toward the printing material P.

The ink ejection apparatus 10 is further provided with a cap member 34 so as to, in an idle period of the printing apparatus 12, seal ejection port forming surfaces of the printing head 14, i.e., nozzle forming surfaces, to prevent the ejection ports from being dried. The cap member 34 is arranged in a non-printing region in a movement path of the carriage 22, i.e., in a home position. When the carriage 22 is moved to the home position, the cap member moves (up) toward the printing head 14 to seal the ejection port forming surfaces. The cap member 34 is, although not illustrated, connected to one end of a tube of a suction pump for performing ink discharge operation (cleaning operation). On the basis of an operation signal from the controller, the suction pump operates, and thereby negative pressure acts on the printing head 14 and the sub-tank 18. This causes the inks and bubbles in the printing head 14 and the sub-tank 18 to be discharged.

Figure 2:
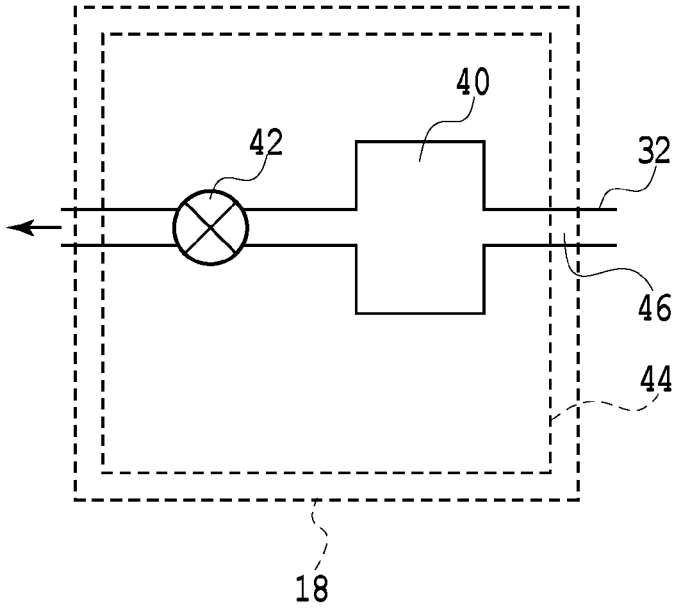
FIG. 2 is a schematic diagram illustrating a relationship among components in one liquid supply unit of a sub-tank of the liquid ejection apparatus in FIG. 1.
Figure 3:
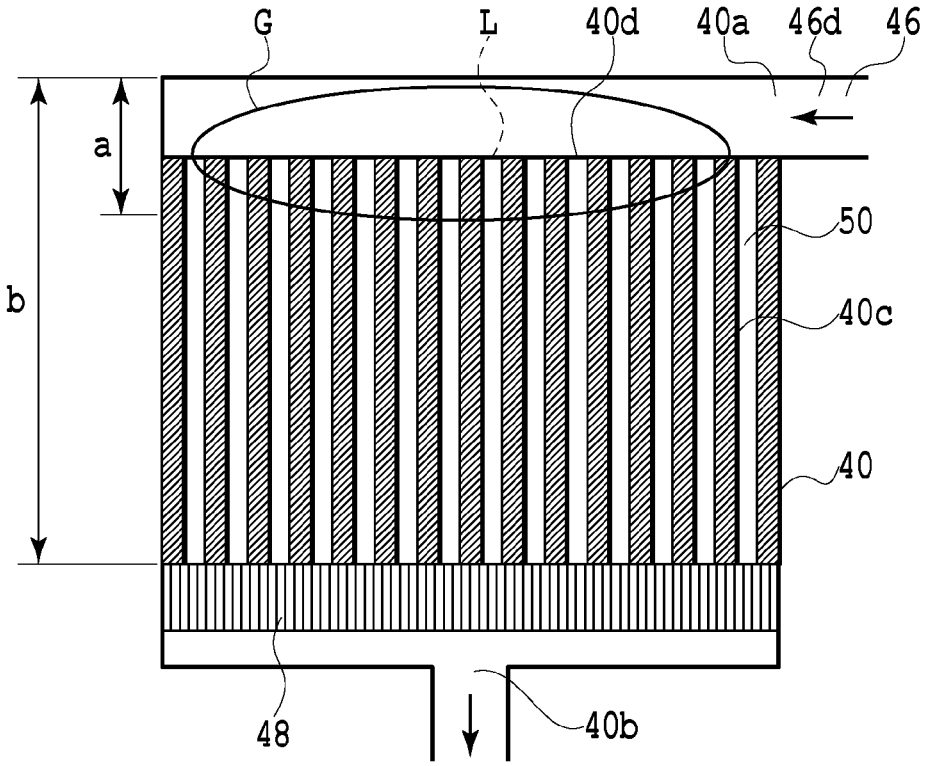
FIG. 3 is a schematic diagram of a filter chamber in the liquid supply unit of the sub-tank of the liquid ejection apparatus in FIG. 1.

Here, the above-described sub-tank 18 is described on the basis of FIGS. 2 and 3. The sub-tank 18 is, as described above, provided with the filter chamber 40 and the valve unit 42, and provided so as to be positioned between the ink cartridges 30 and the printing head 14. As described above, the printing apparatus 12 is configured to be able to eject the four color inks, and therefore the sub-tank 18 is provided with a liquid supply unit 44 including the filter chamber 40 and the valve unit 42 for each of the four color inks. That is, the sub-tank 18 is provided with the four liquid supply units 44. Configurations of the four liquid supply units 44 are the same as one another, and ejection configurations for the four color inks in the ink ejection apparatus 10 are also the same as one another, so that, in the following, only configurations regarding any one of the four ink colors are described.

Ink in one of the ink cartridges 30 is first supplied to a corresponding filter chamber 40 in the sub-tank 18 through a corresponding tube 32 that substantially defines an intermediate supply path 46. The tube 32 is connected to a vertically upper part of the sub-tank 18, and the ink is supplied to the filter chamber 40 from a side of a vertically upper part of the filter chamber 40. Note that the intermediate supply path 46 is configured such that an upstream end thereof is connected to the ink cartridge 30 serving as the liquid containing body and a downstream end 46*d* thereof is connected to the filter chamber 40. A most part of the intermediate supply path 46 is, as described above, defined by the tube 32; the upstream end of the intermediate supply path 46 is defined by the holding member 28; and the downstream end of the intermediate supply path 46 is defined by the sub-tank 18 and structural member of the liquid supply unit 44 provided here. In addition, the downstream end 46*d* of the intermediate supply path 46 is connected to a supply port 40*a* of the filter chamber 40.

The liquid supply unit 44 is provided with the filter chamber 40, and the filter chamber 40 is defined by a filter chamber defining member. A vertically upper side surface of the filter chamber 40 is formed with the supply port 40*a*, and a vertically lower surface of the filter chamber 40 is formed with a discharge port 40*b*. The supply port 40*a* is formed so as to be able to substantially horizontally introduce the ink into the filter chamber 40. Also, the supply port 40*a* is positioned in a vertically upper part as much as possible in the filter chamber 40 (see FIG. 3). On the other hand, the discharge port 40*b* is formed in a bottom part of the filter chamber, in particular, formed in the lowest part of the bottom part such that the ink flows on the basis of its own weight to pass through the filter chamber 40.

The filter chamber 40 is designed to be able to ensure the region for accumulating a bubble (bubble accumulation region or bubble accumulation space). The bubble accumulation region is positioned in the vertically upper part of the filter chamber 40, where the filter chamber 40 is designed so that the bubble accumulation region may expand with substantially including the supply port 40*a* around the supply port 40*a*. Accordingly, the bubble accumulation region includes a communicative connection region that is communicatively connected with the downstream end 46*d* of the intermediate supply path 46. Note that, in FIG. 3, a bubble G is conceptually represented, and in the bubble accumulation region that can be conceptually defined, the bubble G can accumulate.

Also, a filter member 48 is contained in the filter chamber 40 so as to be positioned vertically below the bubble accumulation region of the filter chamber 40. The filter member 48 is arranged in a position separated from the supply port 40*a* vertically downward by a predetermined distance, in particular, arranged in a vertically lower end region in the filter chamber 40 (see FIG. 3). In this embodiment, the predetermined distance is set so as to be able to ensure the sufficient bubble accumulation region. The filter member 48 is provided in the filter chamber 40 such that the ink introduced into the filter chamber 40 completely passes through the filter member 48. In this embodiment, as illustrated in FIG. 3, the filter member 48 is provided so as to substantially horizontally cross in the filter chamber 40, and retained so as to be in close contact with the filter chamber throughout its entire circumference. The filter member 48 is provided so as to trap foreign matters such as dirt to prevent defective sealing of the valve unit 42 due to foreign matter mixing. The filter member 48 is preferably made of twilled stainless steel or nonwoven fabric, or can be made of any of various types of materials and/or members. Normally, between the filter member 48 and the above-described bubble accumulation region, the ink accumulates.

In such a filter chamber 40, a plurality of ink paths (liquid paths) 50 are formed. The plurality of ink paths 50 are formed so as to guide the liquid introduced from the supply port 40*a* toward the filter member 48. The plurality of ink paths 50 are, in this embodiment, a plurality of grooves, and formed by a wall surface of the filter chamber 40 and protrusions 40*c* that protrude from the wall surface into the filter chamber 40. The plurality of ink paths 50 respectively have, in this embodiment, substantially the same shape, and extend downward from vertically above, i.e., extend substantially vertically. The plurality of ink paths 50 are designed so as to extend from the communicative connection region that is communicatively connected with the downstream end 46*d* of the intermediate supply path 46 and included in the bubble accumulation region to vertically below the bubble accumulation region. Therefore, as illustrated in FIG. 3, in the vertical direction, normally, a distance a from an upper end part of the filter chamber 40 to a lower end part of the region where the bubble G accumulates, i.e., the bubble accumulation region, is shorter than a distance b from the upper end part of the filter chamber 40 to a lower end part of the plurality of ink paths 50. More specifically, the plurality of ink paths 50 are formed so as to substantially vertically extend from near the supply port to near the filter member. The plurality of ink paths are particularly designed such that vertically upper end parts (upstream side end parts) of the plurality of ink paths, i.e., upper end surfaces of the protrusions 40*c*, are positioned on a horizontal virtual line that passes along a vertically lower end part of the supply port 40*a*, i.e., on a line L. This is to more surely guide, in the ink paths 50, the ink guided to the supply port 40*a*. Also, here, in order for the plurality of ink paths 50 to surely guide the ink, a guide protrusion 40*d* that connects, on a base side, the plurality of protrusions 40*c* defining the plurality of ink paths 50 and substantially horizontally extends is formed. That is, the protrusions 40*c* extend so as to protrude from the guide protrusion 40*d*. Also, a shape and size of each of the ink paths 50 are designed so as to guide the ink introduced from the supply port 40*a* to the filter member 48 with use of a capillary phenomenon. Accordingly, part or whole of the ink introduced from the supply port 40*a* to the filter chamber 40 can reach the vertically upper end surfaces of the protrusions 40*c* that define the plurality of ink paths; enter the ink paths 50 so as to be drawn by the ink paths 50; and be guided onto a surface of the filter member 48. Then, the ink passes through the filter member 48 and is discharged from the filter chamber through the discharge port 40*b*. Note that, in this embodiment, the filter chamber 40 has a substantially rectangular parallelepiped shape, and one of side surfaces thereof is formed with as many ink paths 50 as possible.

The ink having passed through such a filter chamber 40 is guided to the valve unit 42, and then supplied to the above-described printing head 14 through the valve unit 42. The valve unit 42 is described on the basis of FIGS. 4A and 4B.

The valve unit 42 is positioned on a downstream side of the filter chamber 40, and provided so as to adjust a supply of the liquid to the printing head 14 serving as the ejecting portion. In this embodiment, the valve unit 42 is configured to use negative pressure generated by ink ejection in the printing head 14 to perform opening/closing. The valve unit 42 is wholly positioned vertically below the filter chamber 40. Vertically below the filter chamber 40, an ink supply chamber 52 is formed, and the ink supply chamber 52 is connected to the filter chamber 40 through a path 54 connected to the discharge port 40*b* of the filter chamber 40. In the liquid supply unit 44, a pressure chamber defining recess 56*a* for forming a pressure chamber 56 is formed so as to be positioned laterally to the ink supply chamber 52. The pressure chamber defining recess 56*a* is formed with an outlet port 56*b* connected to an upstream end of a path connected to the printing head 14, and applied with the negative pressure along with the ink ejection from the printing head 14.

The valve unit 42 is provided with: a flexible film member 60 serving as a film member; a spring 62 serving as a biasing member; and a valve body 64 serving as a closing member. In addition, the valve unit 42 includes the ink supply chamber 52 and the pressure chamber 56. The valve body 64 serving as the closing member is provided with a seal member 64*a*, and provided mainly in the ink supply chamber 52. The valve body 64 is biased by the spring 62 so as to close a path 66 that makes a connection between the ink supply chamber 52 and the pressure chamber 56. Also, the film member 60 is provided so as to close the pressure chamber defining recess 56*a*, and defines the pressure chamber 56 together with the pressure chamber defining recess 56*a*. A central part of the film member 60 is attached with a pressure receiving plate 68 formed of a material harder than the film member 60.

Figure 4A:
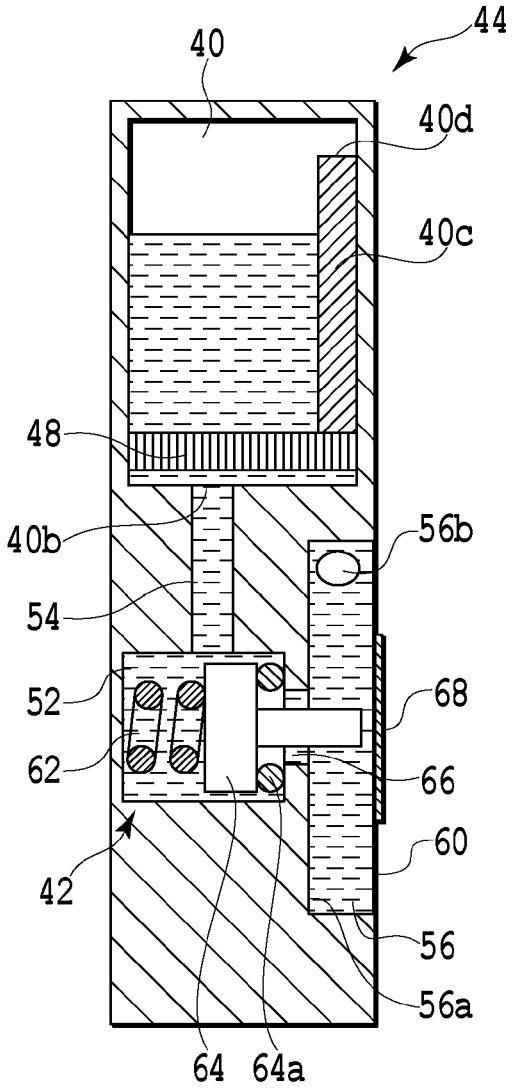
FIGS. 4A and 4B are cross-sectional schematic diagrams of the liquid supply unit of the sub-tank of the liquid ejection apparatus in FIG. 1, and also schematic diagrams respectively illustrating a close state and an open state.
Figure 4B:
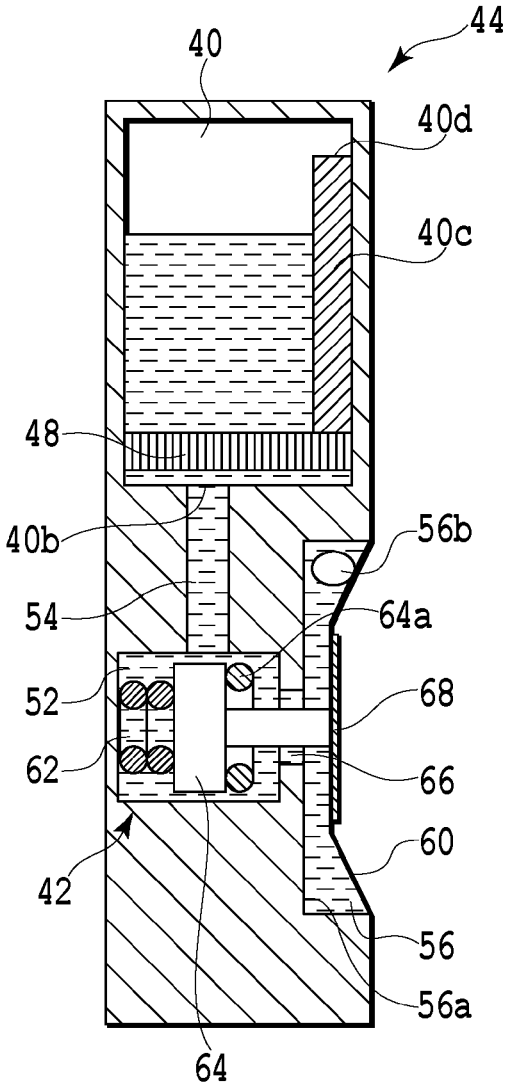

When the printing apparatus 12 is in an idle state, the valve unit 42 is, as illustrated in FIG. 4A, in a close state. When the ink is jetted from the printing head 14, the negative pressure acts on the pressure chamber 56. As illustrated in FIG. 4B, this causes the film member 60 to be deformed so as to press against the valve body 64 with resisting biasing force by the spring 62. As a result, as illustrated in FIG. 4B, the valve unit 42 is brought into an open state. Accordingly, the ink having passed through the filter member 48 of the filter chamber 40 can pass through the path 66 to enter the pressure chamber 56, and further pass through the outlet port 56*b* of the pressure chamber 56 to flow out to the printing head 14. Note that, as can be understood from the above description based on FIGS. 4A and 4B, the film member 60 can have a certain degree of stretch property as necessary.

Note that the valve unit is not limited to the configuration of the valve unit 42 as described above, but can be provided with another configuration and provided with any of various configurations that, for example, use the negative pressure generated by the ink ejection in the printing head 14 to perform the opening/closing. Also, the valve unit may be provided with a configuration not using such negative pressure.

Working and effect in the ink ejection apparatus 10 having the above-described configuration are described below.

First, the ink ejection apparatus for the case where the above-described ink paths 50 are not formed in the filter chamber 40 is described. When a bubble having entered the tube 32 through a connection part between the ink cartridge 30 and the holding member 28 and the like enters the filter chamber, it accumulates in the vertically upper part within the filter chamber. Such a bubble keeps accumulating in the filter chamber, and works so as to substantially narrow a volume of the filter chamber. Accordingly, by performing the above-described discharge operation at regular intervals, such a bubble can be discharged outside through the filter member, the valve unit, and the printing head. In the discharge operation at regular intervals, the ink supply path defined by the tube is closed by an open/close unit provided in the printing apparatus, and the negative pressure is applied to the ink ejection apparatus from the cap member having a function of a suction unit. This causes the bubble accumulating in the filter chamber to be expanded by the reduced pressure and discharged through the filter member, the valve unit, and the printing head. After the discharge operation has been terminated, the negative pressure is released, and therefore the expanded bubble shrinks. Therefore, the bubble always remains in the filter chamber.

In the filter chamber, beside the bubble remaining after the discharge operation as described, a bubble due to permeation from outer air or newly flowing in can accumulate, and the bubble in the filter chamber can be further increased in size. Then, if the volume of the bubble accumulating in the filter chamber is increased, when the ink is supplied, the bubble accumulating in the filter chamber can be pressed by the ink flowing in from the supply port of the filter chamber to be brought into contact with the filter member. This may result in a reduction in effective area of the filter member, and also block the ink from being supplied to the filter member.

For this reason, in the above-described ink ejection apparatus according to the first embodiment, the plurality of ink paths 50 are formed in the filter chamber 40 as described above. The respective ink paths 50 extend from near the supply port 40*a* to near the filter member 48. Accordingly, the ink supplied to the filter chamber 40 can surely reach the surface of the filter member 48. In particular, the respective ink paths 50 are designed so as to be able to guide the ink with use of capillary force, and can therefore more surely retain the ink continuously from the supply port 40*a* to the filter member 48. As a result, regardless of an amount and state of the bubble in the filter chamber 40, the ink ejection apparatus 10 can stably keep supplying the ink to the surface of the filter member 48.

Next, a second embodiment of the present invention is described. A printing apparatus according to the second embodiment is different from the above-described printing apparatus 12 in terms of configuration inside a filter chamber 140 of an ink ejection apparatus provided therein. Accordingly, in the following, in an internal configuration of the filter chamber 140 of the ink ejection apparatus in the second embodiment, only different points in the ink ejection apparatus in the second embodiment from the above-described ink ejection apparatus 10 are described on the basis of FIG. 5. In addition, in the following description, components corresponding to the already described components are denoted by corresponding symbols.

Figure 5:
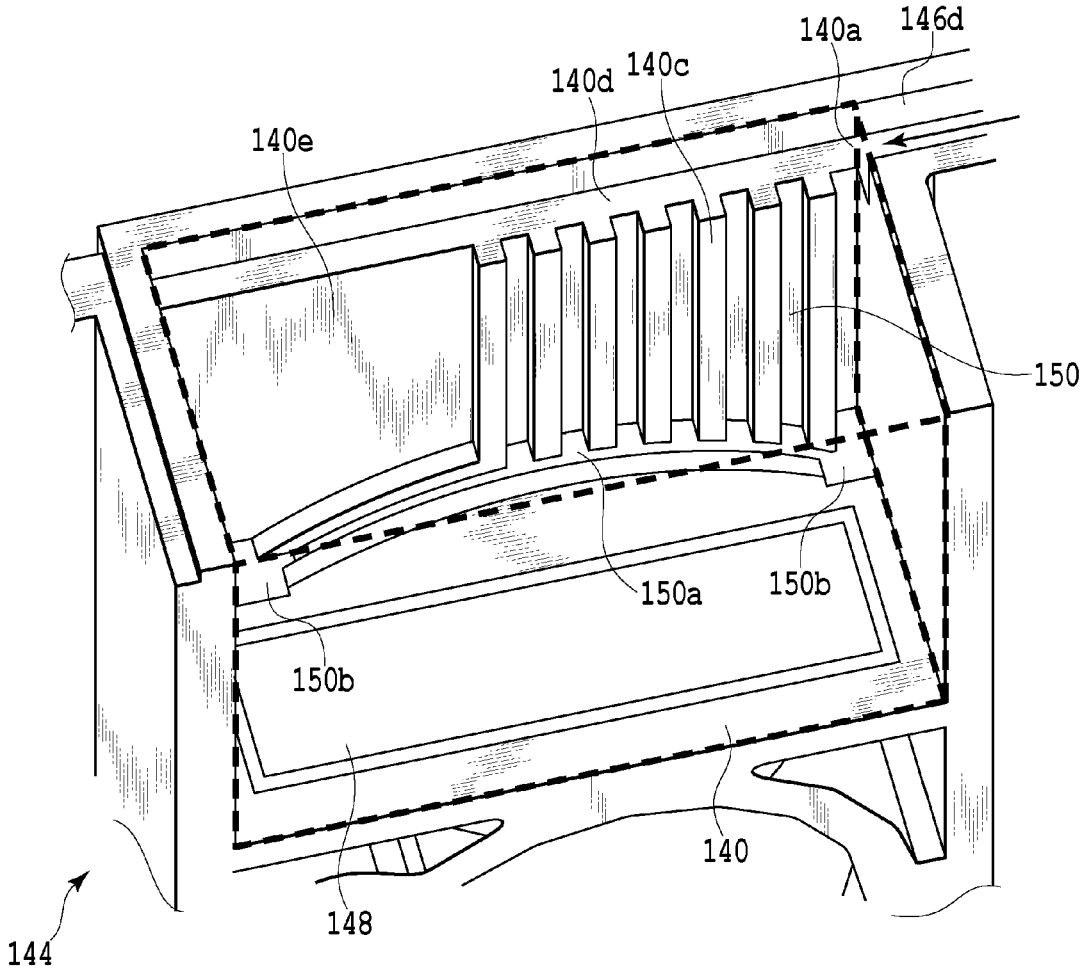
FIG. 5 is a schematic diagram for explaining an internal configuration of a filter chamber of a liquid supply unit of a sub-tank in a liquid ejection apparatus of a printing apparatus according to a second embodiment of the present invention.
Figure 6:
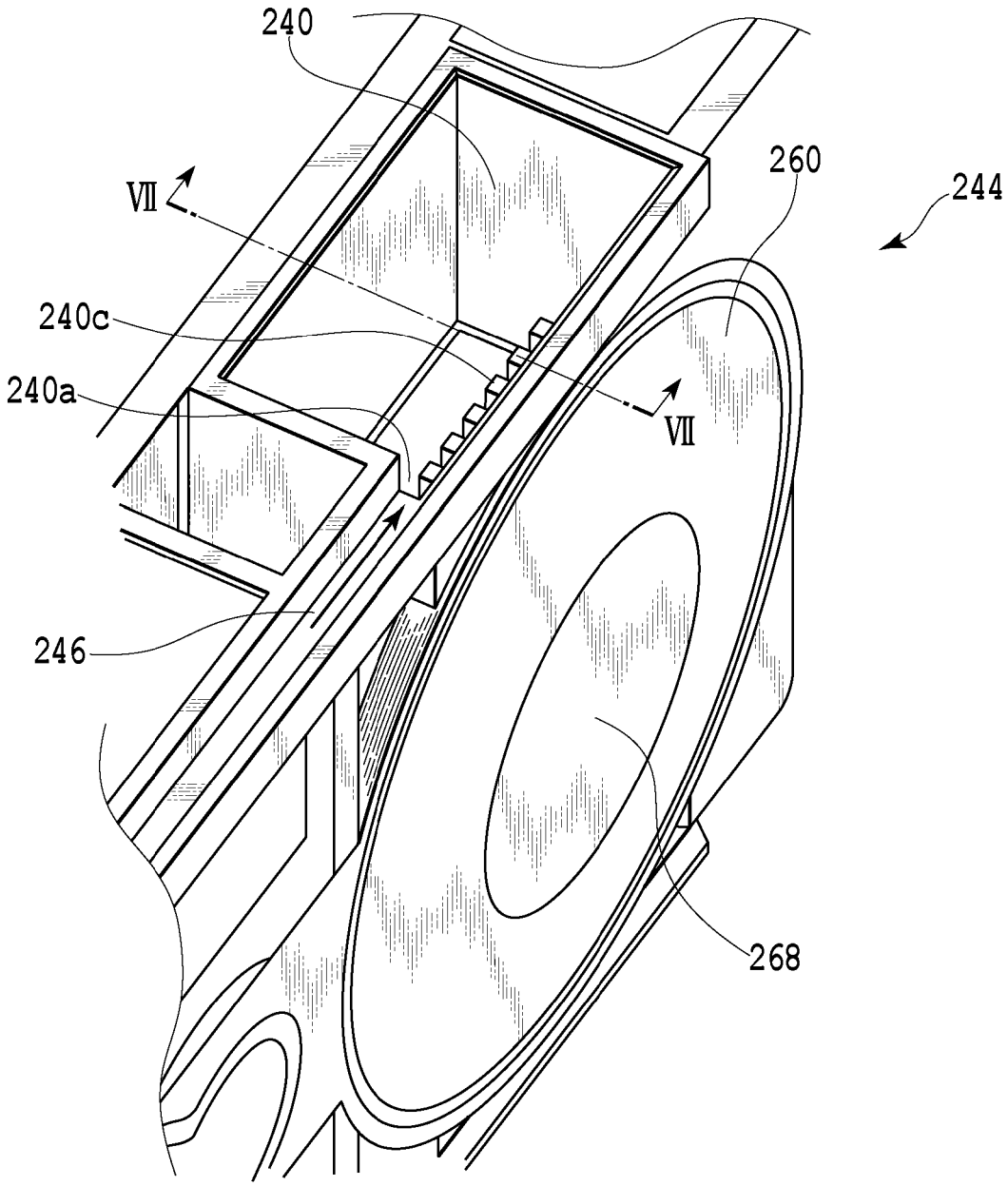
FIG. 6 is a schematic diagram of a part of a liquid supply unit of a sub-tank in a liquid ejection apparatus of a printing apparatus according to a third embodiment of the present invention.
Figure 7:
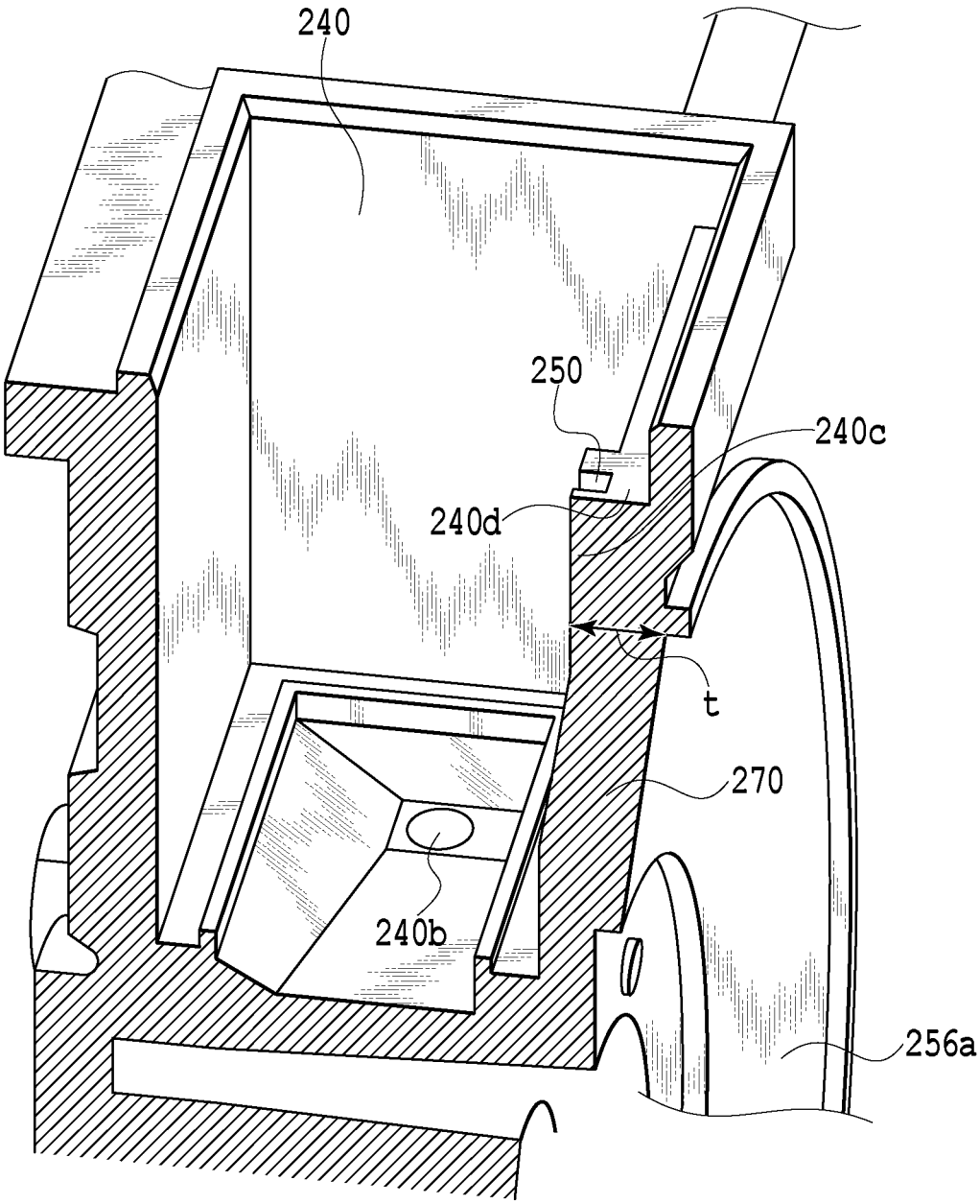
FIG. 7 is a cross-sectional schematic diagram of parts of a filter chamber and its periphery of the liquid supply unit along a VII-VII line of FIG. 6.
Figure 8A:
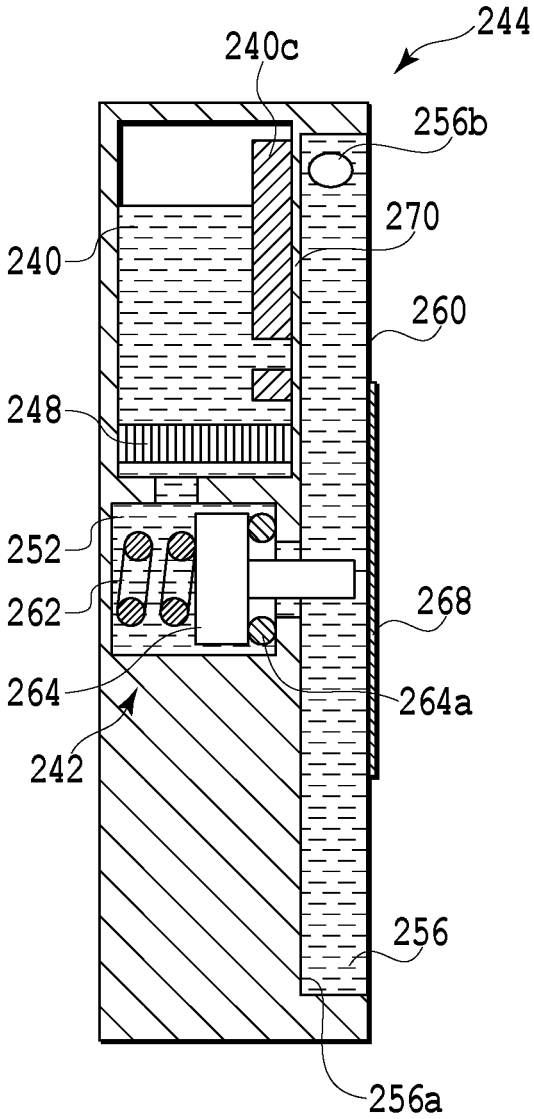
FIGS. 8A and 8B are schematic diagrams of the liquid supply unit of the sub-tank in the liquid ejection apparatus of the printing apparatus according to the third embodiment of the present invention in a cross-section corresponding to the VII-VII line of FIG. 6, and also schematic diagrams respectively illustrating a close state and an open state.
Figure 8B:
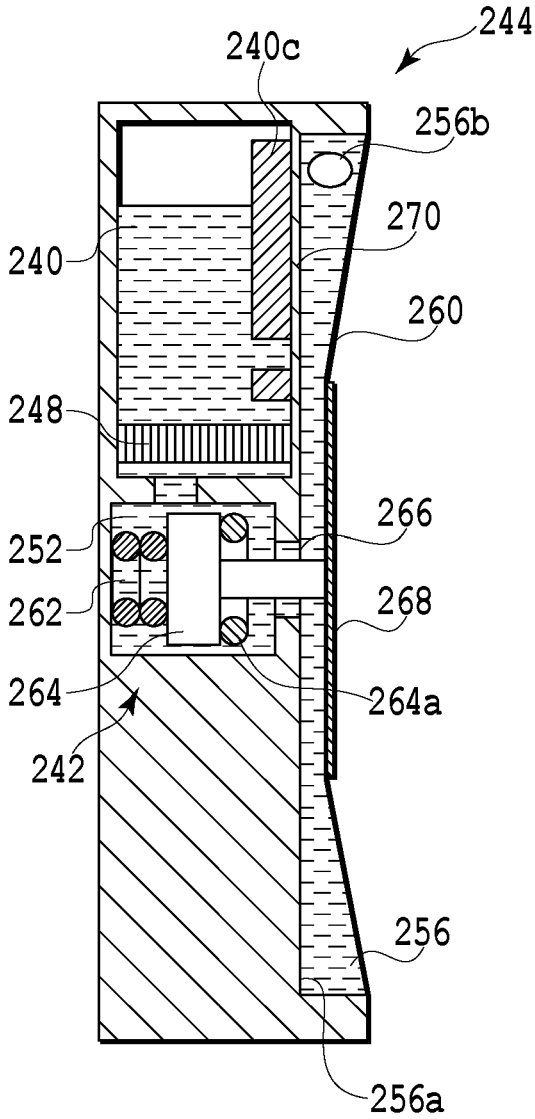

FIG. 5 is a schematic diagram of the filter chamber 140 of a liquid supply unit 144 of a sub-tank in the ink ejection apparatus in the second embodiment, in which, in order to more clearly illustrate an inside of the filter chamber 140, upper and side walls are omitted. The filter chamber 140 is, similarly to the above-described filter chamber 40, formed with a plurality of ink paths 150: however, the ink paths 150 of the filter chamber 140 are different from the ink paths 50 of the filter chamber 40 in terms of the number, installation region, and the like, of ink paths. The filter chamber 140 has a substantially rectangular parallelepiped shape, and on one of side surfaces thereof, in a substantially half region, the ink paths 150 are formed. That is, in a substantially half region 140*e*, no ink path 150 is formed. The number of such ink paths 150 is selectively designed on the basis of a minimum ink amount (flow rate) required to guide ink to a filter member 148, a volume of the filter chamber 140, and the like.

Also, in the second embodiment, the plurality of ink paths 150 of the filter chamber 140 are configured to merge on a vertically lower side of the filter chamber 140 and extend to the filter member 148. A merging part 150*a* is formed in a substantially arc shape, and both end parts 150*b* thereof are formed so as to substantially smoothly continue to a surface of the filter member 148. Note that the merging part 150*a* of the plurality of ink paths 150 is, in this embodiment, designed to be positioned near the filter member 148 so as to be generally positioned vertically below the above-described bubble accumulation region.

Such ink paths 150, i.e., grooves, are designed to be able to draw the ink with use of capillary force. For example, in the case of supplying the ink at a flow rate of 3 g/min to the filter member 148 only from the plurality of ink paths 150, seven ink paths are provided. Also, in each of the seven ink paths 150, a width and depth (protrusion amount of a protrusion 140*c*) in a horizontal cross-section can be set to 0.6 mm and 0.5 mm, respectively, and a space between ink paths 150 (width of the protrusion 140*c*) can be set to 1.2 mm. Note that the number and size as described can be arbitrarily designed. This can also be applied in the above-described first embodiment.

Next, a third embodiment of the present invention is described. An ink ejection apparatus of a printing apparatus according to the third embodiment is different in arrangement from the ink ejection apparatus 10 of the printing apparatus 12 according to the first embodiment. In the above-described first embodiment, the valve unit 42 is wholly positioned vertically below the filter chamber 40. However, a film member 260 of a valve unit 242 in the third embodiment is provided so as to be horizontally aligned with a filter chamber 240. Accordingly, in the following, only a part regarding this point is described. In addition, in the following description, components corresponding to the already described components are denoted by corresponding symbols.

In the ink ejection apparatus in the third embodiment, a pressure chamber defining recess 256*a* is formed so as to be positioned lateral to the filter chamber 240 and ink supply chamber 252. That is, a pressure chamber 256 defined by the flexible film member 260 and the pressure chamber defining recess 256*a* is adjacent to the filter chamber 240 with partially sandwiching one wall part 270. As described, in the case where the pressure chamber 256 and the filter chamber 240 are adjacent to each other, it is particularly desired from the perspective of space saving to decrease a thickness t of the wall part 270 between them. However, on the wall part 270, protrusions 240*c* for defining ink paths 250 are formed. Accordingly, the thickness of the wall part 270 is increased by a protrusion amount of the protrusions 240*c*. For this reason, rigidity of the wall part 270 can be increased. Note that a configuration for the ink paths 250 in the third embodiment is the same as that for the ink paths 150 in the second embodiment.

The above-described three embodiments can be applied with various modifications, and variously partially or wholly combined unless otherwise contradicted. For example, in the above-described three embodiments, each of the ink paths 50, 150, and 250 is configured to be a groove of which one side part is horizontally opened, but can also be configured to horizontally close all directions. That is, as a path of which only upstream and downstream ends are opened, each of the ink paths 50, 150, and 250 can be configured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-192352, filed Aug. 30, 2010, which is hereby incorporated by reference herein in its entirety.

What is claimed is:

1. A liquid ejection apparatus provided with: a movable ejecting portion for ejecting liquid; and an intermediate supply path that is provided so as to supply the liquid contained in a liquid containing body arranged separately from the ejecting portion to the ejecting portion, the liquid ejection apparatus comprising:

a filter chamber provided movably together with the ejecting portion, the filter chamber being provided with a supply port communicatively connected with a downstream end of the intermediate supply path, a filter member arranged in a position distant from the supply port by a predetermined distance vertically downward, and a plurality of liquid paths that extend so as to guide the liquid introduced from the supply port toward the filter member; and a valve unit that is provided movably together with the ejecting portion between the filter chamber and the ejecting portion so as to adjust a supply of the liquid to the ejecting portion.

2. The liquid ejection apparatus according to claim 1, wherein each of the plurality of liquid paths is configured to use a capillary phenomenon to guide the liquid to the filter member.

3. The liquid ejection apparatus according to claim 1, wherein the plurality of liquid paths vertically extend from near the supply port to near the filter member.

4. The liquid ejection apparatus according to claim 1, wherein:

the supply port is formed so as to be able to horizontally introduce the liquid into the filter chamber; and the plurality of liquid paths are designed such that an upstream side end part of each of the plurality of liquid paths is positioned on a horizontal virtual line that passes along a vertically lower side end part of the supply port.

5. The liquid ejection apparatus according to claim 1, wherein the plurality of liquid paths merge to extend to the filter member.

6. A printing apparatus comprising the liquid ejection apparatus according to claim 1.

* * * * *